US005758784A

United States Patent [19]

Chambers

[11] Patent Number: 5,758,784

[45] Date of Patent: Jun. 2, 1998

[54] PORTABLE HINGED RISER

[76] Inventor: John Carlton Chambers, 1943 W. McKinney, Houston, Tex. 77019

[21] Appl. No.: 706,507

[22] Filed: Sep. 6, 1996

[51] Int. Cl.[6] ..... B66C 11/02

[52] U.S. Cl. ..... 211/198; 108/99

[58] Field of Search ..... 211/130, 189, 211/198, 195; 108/91, 99, 100, 101, 64

[56] References Cited

U.S. PATENT DOCUMENTS

| | | | |
|---|---|---|---|
| 199,731 | 1/1878 | Miller | 211/198 |
| 462,084 | 10/1891 | Miller | 211/189 |
| 959,112 | 5/1910 | Cleary | 211/189 |

FOREIGN PATENT DOCUMENTS

| | | | |
|---|---|---|---|
| 353791 | 5/1922 | Germany | 211/198 |

*Primary Examiner*—Peter M. Cuomo
*Assistant Examiner*—Gerald A. Anderson
*Attorney, Agent, or Firm*—Michael B. Jolly

[57] ABSTRACT

A portable hinged riser for use as a multipurpose incremental support device and more particularly for use by emergency personnel to support lifted or separated heavy objects while extricating trapped victims. Multiple devices can be stacked and combined in an assortment of arrangements to accommodate the particular application. Additionally the device is compactly folded to accommodate easy storage of multiple units on a fire truck. The device can further be utilized as a ramp, jack stand, multipurpose chocking device, and a multipurpose shoring device.

10 Claims, 4 Drawing Sheets

PORTABLE HINGED RISER

BACKGROUND OF THE INVENTION

Emergency response personnel are frequently required to extricate injured persons for under vehicles, buildings, or other heavy objects. The extrication process requires rapid response and highly specialized tools to lift or separate the object without further injuring the emergency response personnel or the trapped victim. Hydraulic jacks, jaws of life, inflatable lifting bladders and other devices have been developed for lifting and or separating objects. While these devices are in use a fail safe device is generally employed to incrementally chock-up the displaced object as the object is further displaced thereby minimizing the risk of injury if the lifting device fails or if the load being lifted shifts during the lifting process. Many fire departments require the use of a chocking device and additionally manufacturers of the various lifting devices recommend the use of a chocking device. A common practice among emergency personnel is to build a stepped chocking device from wood using 2×6 pine boards or other similarly dimensioned starting material. The wooden stepped chocking devices are effective however they are bulky and difficult to store on a fire truck given the limited space allocated for such storage. Additionally, the wooden stepped devices are difficult to stack upon each other if a taller chocking device is needed since they are not uniformly deminsioned and are inherently unstable as a result of their design. The present device provides a folding incremental stepped support device which is folded down to a relatively small dimension and providing a unique system of storing multiple units within a relatively small storage space, while also providing a device which can perform a multiplicity of incremental support functions in either a single device use or multiple device use by stacking and combining the units. The device also may be used as a trailer ramp, jack stand, shoring device, multipurpose chocking device, and an elevated floor system.

SUMMARY OF THE INVENTION

It is accordingly an object of the present invention to provide a portable hinged riser for use as a chocking device for incremental chocking a lifted or separated heavy object as the object is lifted or separated providing a fail safe system in case the lifting apparatus fails or if the lifted or separated object shifts while being lifted or separated.

It is accordingly an object of the present invention to provide a portable hinged riser which multiple units can be easily store on a fire truck and quickly deployed by emergency personnel.

It is accordingly an object of the present invention to provide a portable incremental height selective support device which can be combined or stacked with multiply units to form a desired support structure for use by emergency personnel to be deployed as a temporary object support system while emergency personnel performs victim extrication procedures.

It is a further object of the invention to provide a portable hinged riser which can be arranged in a number of orientations either using one unit or a multiplicity of units.

It is another object of the present invention to provide a portable hinged riser which provides both a stable support and is light weight and easy to deploy.

It is another object of the present invention to provide a multipurpose hinged riser for use as a trailer ramp, jack stand, shoring device, chocking device, and an elevated floor system.

DETAILED DESCRIPTION OF THE DRAWINGS

Figure 1:
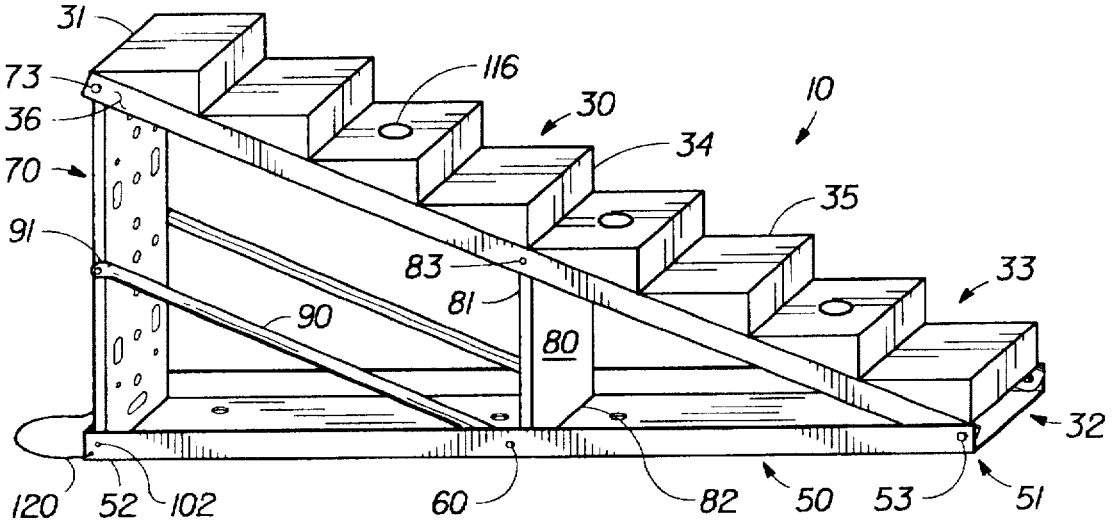
FIG. 1 is a perspective view of a deployed portable hinged riser.

The portable hinged riser 10 is illustrated in FIG. 1 in a perspective view comprising generally the main structural components; a stepped riser 30, a bottom plate 50, a vertical support 70, and a mid vertical support 80.

The stepped riser 30 has a top 31 and a bottom 32 and a multiplicity of steps 33. The stepped riser 30 is further hingedly secured to the bottom plate 50 at the stepped riser bottom 32 and further the vertical support 70 is hingedly attached to the stepped riser top 31 and the mid vertical support 80 is hingedly attached about midway between the stepped riser top 31 and the stepped riser bottom 32. The stepped riser 30 as well as the other structural components are constructed of light weight durable material most preferable aluminum. Stepped riser 30 is preferable about forty inches long when measured from top 31 to bottom 32 and about eight inches wide and the multiplicity of steps 33 extending the entire distance of the stepped riser 30 from top 31 to bottom 32. The steps 33 are permanently attached to the stepped riser 30 most preferable by either being an integral part of the stepped riser 30 or by welding the steps 33 to the stepped riser 30. The steps 33 should most preferable have a rise 34 of about three inches and a run 35 of about four inches which results in about eight steps 33 to be placed on the stepped riser 30. There may be more or less steps depending upon the over dimensions of the unit. The risers 34 and runs 35 should most preferable have a non removable non slip surface which most preferably is a multiplicity of either vertical or patterned groves etched into the riser 34 and runs 35 surfaces, or alternatively gripping material adhered to the surfaces. Additionally, the risers 34 and runs 35 surfaces may be smooth. The stepped riser 30 is the general shape of an inverted channel where two vertical members 36 form the walls of the channel and horizontal member 37 form the top of the inverted channel which forms trough 38 for receiving vertical support member 70 and midpoint vertical support 80 when the units is folded together for storage.

Bottom plate 50 has a hinged end 51 and a locking end 52. hinged end 51 is hingedly secured to the stepped riser 30 bottom 32 by use of pins 53. Like the stepped riser 30 the bottom plate 50 is constructed of durable lightweight material such as aluminum, and further is preferable about thirty two inches long when measured from the hinged end 51 to the locking end 52 and between about eight and about ten inches wide, longer or shorter lengths may be employed depending upon the overall dimensions of the unit. Bottom plate 50 is in a general shape of a channel when viewed from the hinged end 51 with vertical members 55 forming the sides of the channel and horizontal member 56 forming the bottom of the channel and further the channel having a trough 57 for receiving the stepped riser 30 when the stepped riser 30 and the bottom plate 50 are folded along hinge pins 53 and brought together for storing the unit, which folding also results in the vertical support members 70 and 80 to be brought into trough 38 formed by stepped riser 30. Bottom plate 50 further is equipped with a dam 58 positioned at the locking end 52 of the bottom plate 50, the dam 58 functions as a stop for vertical support 70, further two locking engagement apertures 59 are positioned on each vertical channel member 55 at the locking end 52 of the bottom plate 50 and two folded locking apertures 60 are positioned on each vertical channel member 55 and aligned to provide an receiving area for locking means 100 when the unit is folded.

Vertical support 70 is a planar member and has a locking end 71 and a hinged end 72 and is between about twenty five and about twenty seven inches long when measured from the each end and about eight inches in width or a width dimension which will allow the vertical support member 70 to fit in trough 38 when the unit folded up for storage. Again the dimensions of the vertical support 70 may vary depending upon the unit's desired overall size. The vertical support hinged end 72 is hingedly attached to the stepped riser top end 31 by use of most preferable a single hinge pin 73 or alternatively two hinge pins. Midpoint vertical support 80 has a hinged end 81 and a support end 82 and is between about twelve inches and about fourteen inches long when measured from the hinged end 81 to the support end 82. The midpoint vertical support hinged end 81 is further hingedly secured to the stepped riser 30 between the vertical members 36 by use of hinge pins 83. The midpoint vertical support end 82 is connected to the vertical support 70 by linkage members 90, the linkage members are attached to the vertical support 70 at about the mid point between the vertical support locking end 71 and hinged end 72. Linkage members 90 further have a short dog leg 91 at the end connecting to the vertical support 70 so that the unit may be folded. The linkage members 90 are further rotatable secured at each end so that as the vertical support 70 moves about its hinge pins 73 the linkage members 90 cause the midpoint vertical support 80 to also move about its hinged pins 83. The midpoint vertical support 80, vertical support 70, troughs 38 and 57 must be deminsioned so that when the unit folded for storage, the vertical supports 70 and 80 pivot about their hinges and into the space created by trough 38 while the stepped riser 30 goes into the space created by trough 57 thus forming a collapsed unit ready for storage.

Figure 2A:
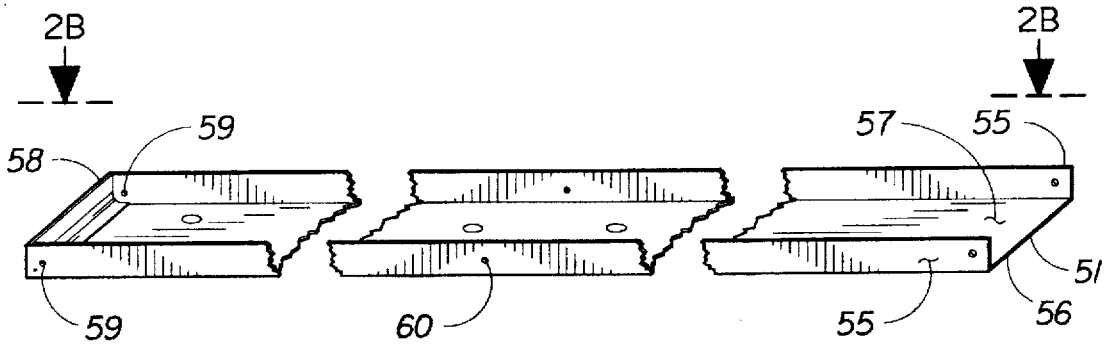
FIG. 2*a* is a perspective view of the bottom plate.
Figure 2B:
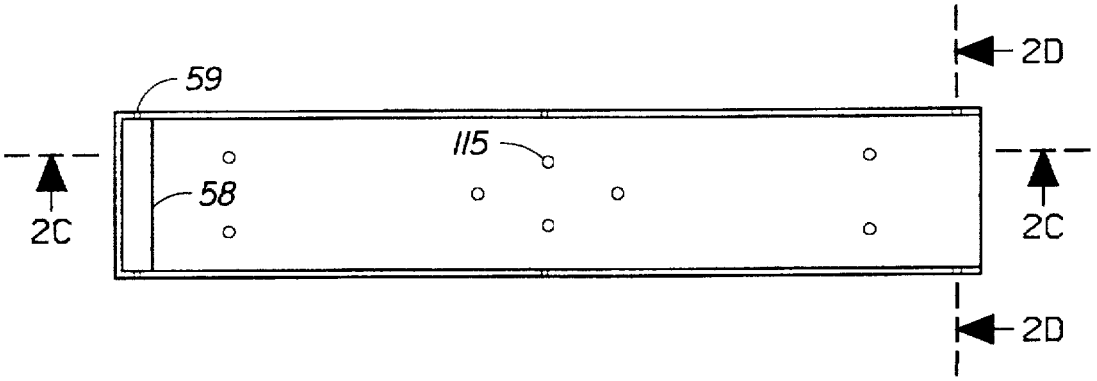
FIG. 2*b* is a top view of the bottom plate.
Figure 2C:
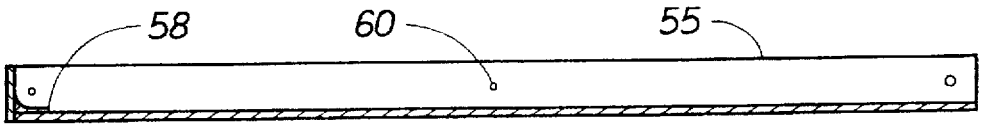
FIG. 2*c* is a side view of the bottom plate.
Figure 2D:
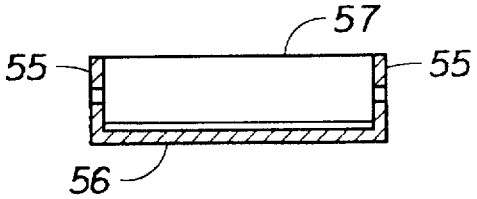
FIG. 2*d* is an end view of the bottom plate.
Figure 2E:
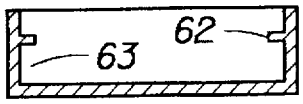
FIG. 2*e* is an end view of the bottom plate illustrating the locking line engegement member.
Figure 3A:
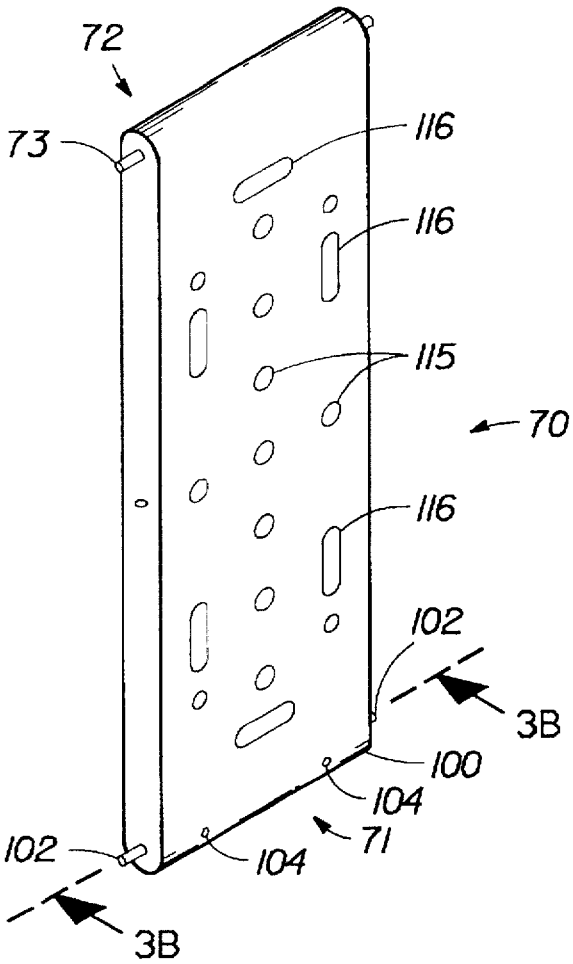
FIG. 3*a* is a perspective view of the vertical plate illustrating the deployment locking means.
Figure 3B:
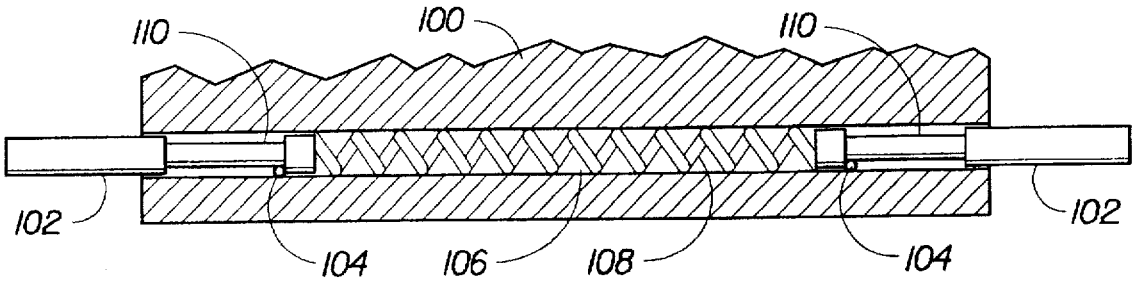
FIG. 3*b* is a cross sectional view of the locking means taken along line I of FIG. 3*a*.
Figure 3C:
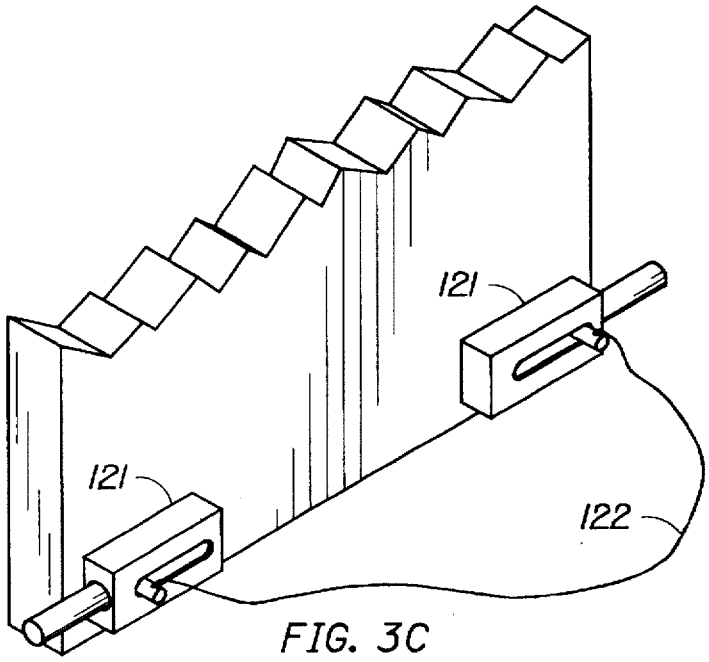
FIG. 3*c* illustrates a locking means comprising two spring loaded units attached to the vertical support member.
Figure 4:
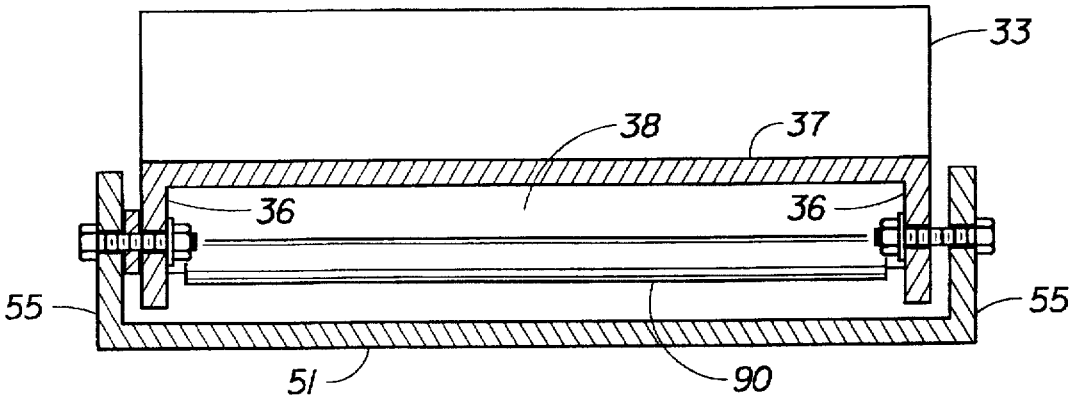
FIG. 4 is an end view of the riser unit illustrating components positions when the unit is folded for storage.

Locking means 100 is attached at the locking end 71 of vertical support 70 and has two locking pins 102 which are biased to protrude along the plane formed by the vertical support member and perpendicular to the long edge of the rectangle formed by the vertical support member 70. The locking pins 102 are biased to extend in opposite directions from the vertical support member 70 and further retaining pins 104 engage locking pin shoulders 110 thereby retaining the locking pins 102 within the locking pin housing 106. The locking pin housing 106 is a cylindrical housing extending between each long side of the rectangle formed by the vertical support member 70 and further said cylindrical locking pin housing being positioned at the end of the locking end 71 of the vertical support member 70 so that the cylindrical housing is about the same length as the vertical support member 70 is wide. The locking pins 102 biasing means is a spring 108 positioned internally within said cylindrical housing 106 and further in contact with each locking pin 102 thereby urging each locking pin 102 to protrude until contacting said locking pin shoulders 110. The locking pins should be deminsioned to fit into the engagement apertures 59 and then further extend beyond the bottom member vertical members 55 so that the locking pins 102 can be visually confirmed to be in the locking engaged position. The locking pins 102 are disengaged by depressing the pins 102 and at the same time urging the vertical support member 70 to swing toward the folding position. The locking means 100 may alternatively be a pair of spring loaded pins units 121 as illustrated in FIG. 3*c* and further said units 121 having a release cord 122 attached to each unit 121 which when pulled releases the locking pins from engagement. When the locking pins 102 are disengaged from the bottom support member apertures 59 it is most preferable that the vertical support member locking end 71 be retained within the space between the bottom support vertical members 55 so that the entire unit does not unfold. The use of a retaining means which then allows the vertical support locking end 71 and the locking pins 102 to remain slidingly engaged with the bottom support member 50 when the vertical support locking end 71 is moved from the locked position to the folded position includes a engagement member 62 fixedly attached on each bottom support vertical member 55 creating a space 63 between the engagement member 62 and the bottom horizontal member 56 as illustrated in FIG. 2*e*. The space 63 allows the locking pins 102 to slide along the inside of the bottom support member trough 57 when the locking pin travel from the storage locking apertures 60 and the locking apertures 59.

A carrying cable 120 is most preferable attached to the bottom support member locking end 52. The carrying cable not only functions as a carry handle but also as a means for retrieving the unit from under lifted objects so that the operator does not endanger himself to retrieve the unit.

Figure 5A:
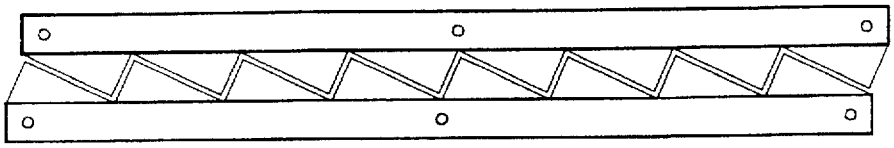
FIG. 5*a* illustrates two units stacked for storage.
Figure 5B:
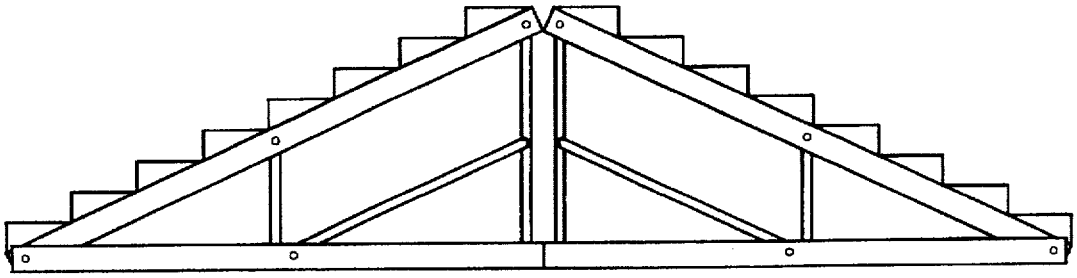
FIG. 5*b* illustrates two units positioned end to end.
Figure 5C:
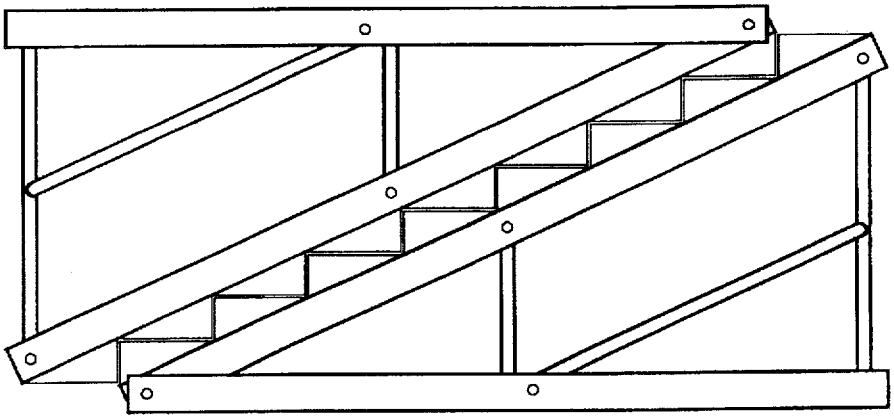
FIG. 5*c* illustrates two units stacked to form a raised platform.

Multiple units 10 may be stacked in an assortment of configurations as illustrated in FIGS. 5*a–c*. A means for locking each unit together is provided which is comprised of a multiplicity of apertures 115 on the bottom member 50 surface and vertical support member 70 which apertures 115 are systematically aligned so that as units 10 are brought into contact with each other the apertures align multiple units in 90° increments and a securing devices such as a bolt, tractor pin and means can be employed to secure the units 10 together. Additionally, a multiplicity of oblong apertures 116 are provided on the vertical support member 70 and bottom support member 50 and the steps 33 in random locations to provided connection or through points for attachment cables or chains.

I claim:

1. A portable hinged riser, comprising;

a) a bottom support member having a hinged end and a locking end, b) a vertical support member having a hinged end and a locking end, c) a stepped riser platform having top and bottom ends and further said platform having a multiplicity of steps the steps positioned incremental between the top and bottom ends, said bottom end being hingedly secured to the hinged end of said bottom support and said top end being hingedly secured to said vertical support hinged end.

d) a midpoint vertical support member having a hinged end and a support end, said support end being linkagely attached at a point midway between said vertical support member hinged end and the vertical support member locking end, further said hinged end being hingedly attached to the stepped riser platform at a point midway between the stepped riser platform top and bottom, and e) a means for lockingly engaging said bottom support member locking end and said vertical support member locking end.

2. Apparatus as set forth in claim 1 wherein said bottom support member further comprises a planar member in the general shape of a rectangle and said planar cross section taken perpendicular to the longitudinal axis of the planar member said cross section being in the general shape of a channel wherein said planar member forms the bottom of said channel and the walls of said channel being two vertical members further said planar member being about thirty two inches long and having about eight to about nine inches between the two vertical members and further said vertical members extending from long sides of said planar member about one to about three inches.

3. Apparatus as set forth in claim 1 wherein said bottom support member further comprises a means for engaging said locking means, said engaging means being at the locking end of said bottom support member and further a midpoint engaging means being positioned about midpoint between said bottom support member locking end and the bottom support member hinged end.

4. Apparatus as set forth in claim 1 wherein said bottom support member further comprises a planar member in the general shape of a rectangle and said planar cross section taken perpendicular to the longitudinal axis of the planar member said cross section being in the general shape of a channel wherein said planar member forms the bottom of said channel and the walls of said channel being two vertical members, further said planar member being about thirty two inches long and having about eight to about nine inches between the two vertical members and further said vertical members extending from long sides of said planar member about one to about three inches, further said bottom support member comprises a means for engaging said locking means, said engaging means comprising apertures positioned at the locking end of said bottom support member vertical members and further apertures positioned on the vertical members about midpoint between said bottom support member locking end and the bottom support member hinged end.

5. Apparatus as set forth in claim 4 wherein said bottom support member further comprises a means for slidingly retaining said locking means between said bottom support member vertical members so that as the locking means is disengaged from the bottom member locking end and the vertical support member is rotated along its hinged end, the locking means is retained within the space between the bottom support member vertical members.

6. Apparatus as set forth in claim 1 wherein said vertical support member further comprises a planar member in the general shape of a rectangle being about eight inches wide and about twenty four to about twenty eight inches long and further constructed of material about ⅜ to about ¾ inch thick, further comprising a locking means attached to said vertical support member locking end and further said vertical support hinged end being hingedly secured to the stepped riser hinged end by the use of a hinge pin, said hinge pin being long enough to extend the width of the vertical support member and the stepped riser width.

7. Apparatus as set forth in claim 1 wherein said stepped riser platform further comprises a planar member in the general shape of a rectangle and a planar cross section taken perpendicular to the longitudinal axis of the planar member said cross section being in the general shape of an inverted channel wherein said planar member forms a top of said channel and the walls of said channel being two vertical members, further said planar member being about forty inches long and about six to about nine inches between the two vertical members and further said vertical members extending from said rectangular long sides about one to about three inches further said stepped riser comprises a multiplicity of steps positioned incrementally between said stepped riser top and bottom ends said steps having runs between about 3 and about 5 inches and risers about 3 to about 5 inches, further said riser and runs having permanently attached friction means for preventing slippage on the riser and run surfaces, and further a hinge pin hingedly attaching said stepped riser bottom end to the bottom support member hinged end said hinge pin extending to width of said bottom support member.

8. Apparatus as set forth in claim 1 wherein said means for lockingly engaging said bottom support member locking end and said vertical support member locking end, further comprises two pins positioned at the vertical support member locking end and further said pins being biased to extend oppositely each other, perpendicular to the longitudinal axis and along the plane of the rectangle formed by said vertical support member, said pins being biased by a spring positioned between each pin, said spring urging each pin away from each other, further said pins and said spring being positioned within a cylinder, said cylinder extending the width of said vertical support member and further being positioned at the locking end of said vertical support member so that the pins may engage with the lock engaging means at the locking end of the bottom support member, further a pin retaining means retaining said pins within said cylinder so that the pins extend from the vertical support member a desired distance, said retaining means comprising a retaining pin extending perpendicular to the axis of the cylinder and through the cylinder contacting a pin retaining shoulder when the pins are fully extended, further a locking release cable attached to the pins so that as the cable is pulled the pins are urged to retract into the cylinder and disengage with the bottom support member.

9. Apparatus as set forth in claim 1 wherein said means for lockingly engaging said bottom support member locking end and said vertical support member locking end further comprises two spring loaded pin units attached to each corner of the vertical support member locking end, the spring loaded units further comprising a locking pin extending from the vertical support member locking end and engaging the bottom support member locking apertures when the vertical support member locking end is brought in contact with the bottom support member locking end.

10. Apparatus as set forth in claim 1 wherein said vertical support member further comprises a planar member in the general shape of rectangle being about eight inches wide and about twenty four to about twenty eight inches long and further constructed of material about ⅜ to about ¾ inch thick.

* * * * *